US011731011B2

(12) United States Patent
Morales et al.

(10) Patent No.: US 11,731,011 B2
(45) **Date of Patent: *Aug. 22, 2023**

(54) GOLF CLUB HEAD WITH FLEXIBLE SOLE

(71) Applicant: KARSTEN MANUFACTURING CORPORATION, Phoenix, AZ (US)

(72) Inventors: Eric J. Morales, Laveen, AZ (US); Erik M. Henrikson, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 8 days.

This patent is subject to a terminal disclaimer.

(21) Appl. No.: 17/088,440

(22) Filed: Nov. 3, 2020

(65) Prior Publication Data

US 2021/0046362 A1 Feb. 18, 2021

Related U.S. Application Data

(63) Continuation of application No. 16/455,599, filed on Jun. 27, 2019, now Pat. No. 10,821,336.

(60) Provisional application No. 62/861,247, filed on Jun. 13, 2019, provisional application No. 62/856,637, filed on Jun. 3, 2019, provisional application No. 62/690,858, filed on Jun. 27, 2018.

(51) Int. Cl.
*A63B 53/04* (2015.01)

(52) U.S. Cl.
CPC ..... *A63B 53/0466* (2013.01); *A63B 53/045* (2020.08); *A63B 53/0412* (2020.08); *A63B 53/0433* (2020.08)

(58) Field of Classification Search
CPC ..... A63B 53/0466; A63B 53/0412; A63B 53/0433; A63B 53/045; A63B 53/0408
See application file for complete search history.

(56) References Cited

U.S. PATENT DOCUMENTS

| | | | | |
|---|---|---|---|---|
| 4,511,145 | A | 4/1985 | Schmidt | |
| 4,850,593 | A * | 7/1989 | Nelson | A63B 53/0466 473/328 |
| 5,080,366 | A | 1/1992 | Okumoto et al. | |
| 5,295,689 | A | 3/1994 | Lundberg | |
| 6,296,576 | B1 | 10/2001 | Capelli | |
| 6,964,617 | B2 * | 11/2005 | Williams | A63B 53/0466 473/345 |

(Continued)

FOREIGN PATENT DOCUMENTS

| | | |
|---|---|---|
| JP | 0482574 | 3/1992 |
| JP | 5046672 | 10/2012 |
| JP | 2016221170 | 12/2016 |

OTHER PUBLICATIONS

PCT International Search Report and Written Opinion dated Sep. 12, 2019 from corresponding PCT Application No. PCT/US2019/039618.

*Primary Examiner* — Michael D Dennis

(57) ABSTRACT

Described herein are embodiments of golf club heads with flexible soles. In one embodiment, the golf club head includes a body having a crown opposite a sole, a toe opposite a heel, a back end opposite a front end, and a hosel. The golf club head also includes a sole curvature profile comprising a radius of curvature that varies as the sole curvature profile extends between the front end and the back end. The radius of curvature is configured to increase the flexure of the entire golf club head, thereby increasing the internal energy of the golf club head.

19 Claims, 8 Drawing Sheets

(56) References Cited

U.S. PATENT DOCUMENTS

| | | | | |
|---|---|---|---|---|
| 7,056,229 | B2 | 6/2006 | Chen | |
| 7,066,835 | B2 | 6/2006 | Evans et al. | |
| 7,273,419 | B2 | 9/2007 | Evans et al. | |
| 7,399,237 | B2 | 2/2008 | Evans et al. | |
| 7,452,287 | B2 | 11/2008 | Erickson et al. | |
| 7,641,568 | B2 * | 1/2010 | Hoffman | A63B 53/0466 473/332 |
| 7,651,410 | B2 | 1/2010 | Shimazaki | |
| 7,803,067 | B2 | 9/2010 | Horacek et al. | |
| 7,942,759 | B2 | 5/2011 | Matsunaga et al. | |
| 8,012,038 | B1 * | 9/2011 | Beach | A63B 53/06 473/345 |
| 8,353,784 | B2 | 1/2013 | Boyd et al. | |
| 8,360,900 | B2 | 1/2013 | Snyder | |
| 8,986,131 | B2 | 3/2015 | Stites et al. | |
| 9,174,103 | B2 | 11/2015 | Curtis et al. | |
| 9,498,684 | B2 | 3/2016 | Motokawa | |
| 9,393,473 | B2 | 7/2016 | Knight | |
| 9,498,688 | B2 | 11/2016 | Galvan et al. | |
| 10,286,264 | B2 * | 5/2019 | Yoshida | A63B 53/0466 |
| 2003/0171162 | A1 | 9/2003 | Park | |
| 2003/0190975 | A1 | 10/2003 | Fagot | |
| 2004/0192463 | A1 | 9/2004 | Tsurumaki et al. | |
| 2005/0049081 | A1 | 3/2005 | Boone | |
| 2009/0124410 | A1 * | 5/2009 | Rife | A63B 53/0466 473/328 |
| 2011/0152004 | A1 | 6/2011 | Ban et al. | |
| 2015/0119163 | A1 * | 4/2015 | de la Cruz | A63B 60/54 473/329 |
| 2017/0043222 | A1 * | 2/2017 | Stokke | A63B 53/0466 |
| 2017/0157473 | A1 | 2/2017 | Jertson | |

* cited by examiner

GOLF CLUB HEAD WITH FLEXIBLE SOLE

CROSS-REFERENCE TO RELATED APPLICATIONS

This is a continuation of U.S. patent application Ser. No. 16/455,599, filed on Jun. 27, 2019, and issued as U.S. Pat. No. 10,821,336 on Nov. 3, 2020, which claims the benefit of U.S. Provisional Patent Appl. No. 62/861,247, filed on Jun. 13, 2019, U.S. Provisional Patent Appl. No. 62/856,637, filed on Jun. 3, 2019, and U.S. Provisional Patent Appl. No. 62/690,858, filed on Jun. 27, 2018, the contents of which are incorporated fully herein by reference.

FIELD OF INVENTION

This disclosure relates generally to golf clubs and relates more particularly to golf club heads with flexible soles.

BACKGROUND

Metalwood golf club heads typically include a high strength metal faceplate attached to a hollow metal club body. When a metalwood club head impacts a golf ball, the travel distance of the ball is largely a function of the kinetic energy imparted from the club head to the ball. During impact, some of the energy is lost as a result of the collision. One measure of energy transfer from the club head to the golf ball is the Coefficient of Restitution ("COR"). Most of the energy is lost as a result of high stresses and deformations of the golf ball, as opposed to the relatively small deformations of the club head. To reduce the amount of energy lost during impact, and thus increase the energy transfer efficiency, the stresses and rate of deformation experienced by the golf ball during impact must be reduced.

One way to accomplish this is to allow more deformation of the club head during impact. For example, this can be achieved by increasing the flexure of the faceplate. Typical means of increasing faceplate flexure include uniform faceplate thinning, varying a thickness of the faceplate, providing ribbed stiffeners on the faceplate, utilizing lighter materials such as titanium, and providing forged, stamped, or machined metal faceplates as opposed to cast faceplates.

Another way to increase deformation of the club head during impact is to increase the deformation of the club head body. This can be achieved by altering the geometry of the club head body to have a radius of curvature between the front and back regions. Some prior art club heads have accomplished this by providing sole regions having increased camber outward between the front and the back of the club head. The increased camber outward distributes stresses across a broader area in the sole region, allowing the thickness of the sole region to be reduced to promote larger deformations. However, these prior art sole regions "bow out" toward the ground and away from a centerline of the club head. This results in a strikeface that resides higher off the ground at an address position, making it more difficult to achieve desirable contact at impact. There is a need in the art for a golf club head with significant camber in the sole that does not bow outward towards the ground at an address position, or other structures that provide optimal deformation of the golf club.

Figure 1:
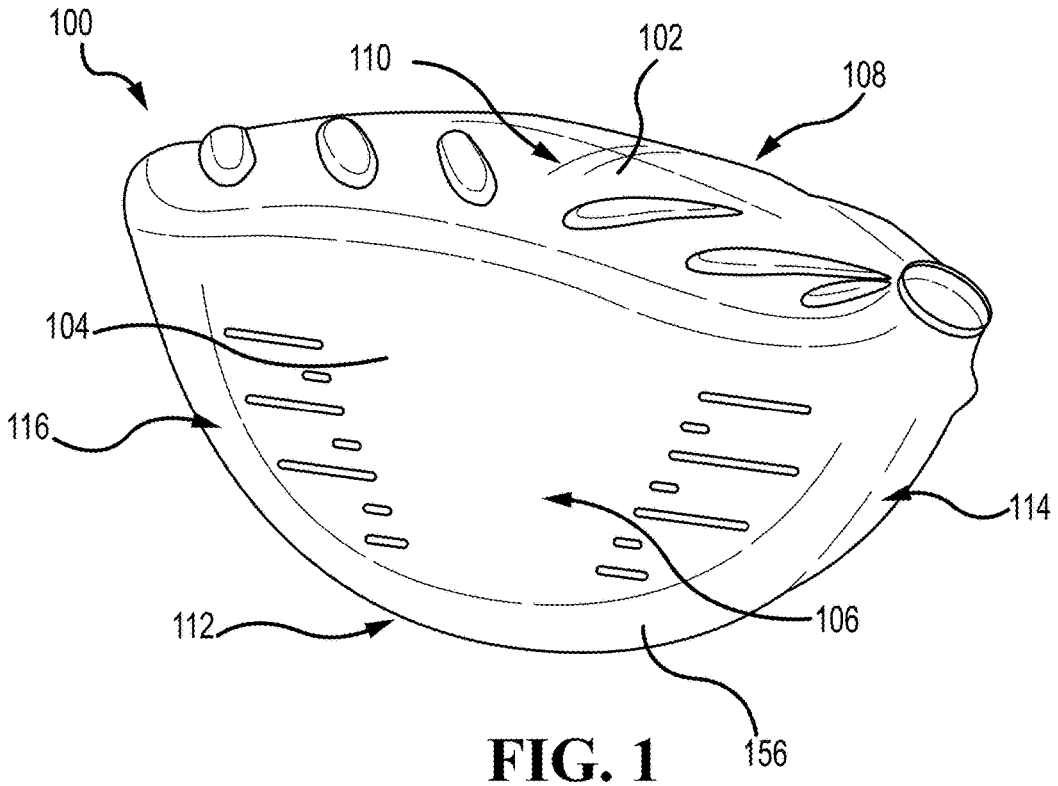
FIG. 1 is a front, heel-side perspective view of a golf club head.

For simplicity and clarity of illustration, the drawing figures illustrate the general manner of construction, and descriptions and details of well-known features and techniques may be omitted to avoid unnecessarily obscuring the golf clubs and their methods of manufacture. Additionally, elements in the drawing figures are not necessarily drawn to scale. For example, the dimensions of some of the elements in the figures may be exaggerated relative to other elements to help improve understanding of embodiments of the golf clubs and their methods of manufacture. The same reference numerals in different figures denote the same elements.

DETAILED DESCRIPTION

Described herein is a metalwood golf club head including a body having a reverse camber sole. Specifically, the sole of the club head includes an indented region, and the indented region includes a region of reversed concavity as compared to a concavity of remaining regions of the sole. The reverse camber sole follows a more tightly curved profile between a front end of the club head and a back end of the club head, as compared to prior art metalwood club heads. This promotes greater deflection in the sole of the body as the club head impacts a golf ball. The relatively greater deflection of the club body can yield higher internal energy of the club head as compared to prior art metalwood golf clubs. The higher the internal energy of the club head translates to farther traveling golf shots. Additionally, the relatively greater deflection of the sole during impact can lead to a reduction in ball spin rate experienced by the golf ball upon impact with the club head.

In some embodiments, the club head described herein can also include one or more internal beams attached to the sole at a first end and at a second end and extending through an internal cavity of the golf club head between the first and second ends. The first end of each beam is attached to the sole at a location proximate the front end of the golf club head, and the second end of each beam is attached to the sole at or near the indented region. The internal beams further promote bending in the sole during impact with the golf ball, while reinforcing the sole to prevent failure.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of golf clubs and methods of manufacture described herein are, for example, capable of operation in sequences other than those illustrated or otherwise described herein. Furthermore, the terms "contain," "include," and "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "back," "top," "bottom," "side," "under," "over," and the like in the description and in the claims, if any, are used for descriptive purposes and not necessarily for describing permanent relative positions. It is to be understood that the terms so used are interchangeable under appropriate circumstances such that the embodiments of golf clubs and methods of manufacture described herein are, for example, capable of operation in other orientations than those illustrated or otherwise described herein. The term "coupled," as used herein, is defined as directly or indirectly connected in a physical, mechanical, or other manner.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

FIGS. 1-4 illustrate an embodiment of a golf club head 100 having a flexible sole 112. The sole 112 is designed to camber inwards (away from a ground plane) and thereby increase the flexibility of the golf club head 100 upon impact with a golf ball. The increase in provides greater internal energy generated by the golf club head 100. This increase in internal energy increase the ball speed of a golf ball struck by golf club head 100. Increased ball speed directly translates late to farther traveling golf shots. The inward camber sole provides a 5-10 yards greater distance over a golf club head without the inward camber sole. The golf club head 100 can further comprise one or more stiffening beams 290 to moderate and control the flexibility of the golf club head 100.

I. INWARD CAMBER GOLF CLUB HEAD

FIGS. 1-4 illustrate a golf club head 100 having a body 102 and a strikeface 104. The body 102 of the club head 100 includes a front end 106, a back end 108 opposite the front end 106, a crown 110, the sole 112 opposite the crown 110, a heel 114, and a toe 116 opposite the heel 114. The sole 112 of the golf club head 100 comprises a ground plane 113, wherein the ground plane 113 is tangent to the sole 112 when the golf club head 100 is at an address position to strike a golf ball.

The club head 100 is a hollow body club head. The golf club head 100 comprises a body 102 and a strikeface 104. The body 102 and strikeface 104 define an internal cavity 118 (FIG. 4) of the golf club head 100. In the illustrated embodiment, the body 102 also defines the crown 110, the sole 112, the heel 114, the toe 116, the back end 108, a perimeter portion 120 (FIG. 3) of the front end 106 of the club head 100. These features can also define a hollow body. The perimeter portion 120 of the body 102 further defines an opening 122 at the front end 106 of the club head 100, and the strikeface 104 is coupled to the perimeter portion 120 to fill the opening 122, thereby forming the club head 100. In other embodiments (not shown), the strikeface 104 can extend over the entire front end 106 of the club head and can include a return portion extending over at least one of the crown 110, the sole 112, the heel 114, and the toe 116. In these embodiments, the return portion of the strikeface 104 is coupled to the body 102 to form the club head 100.

Figure 3:
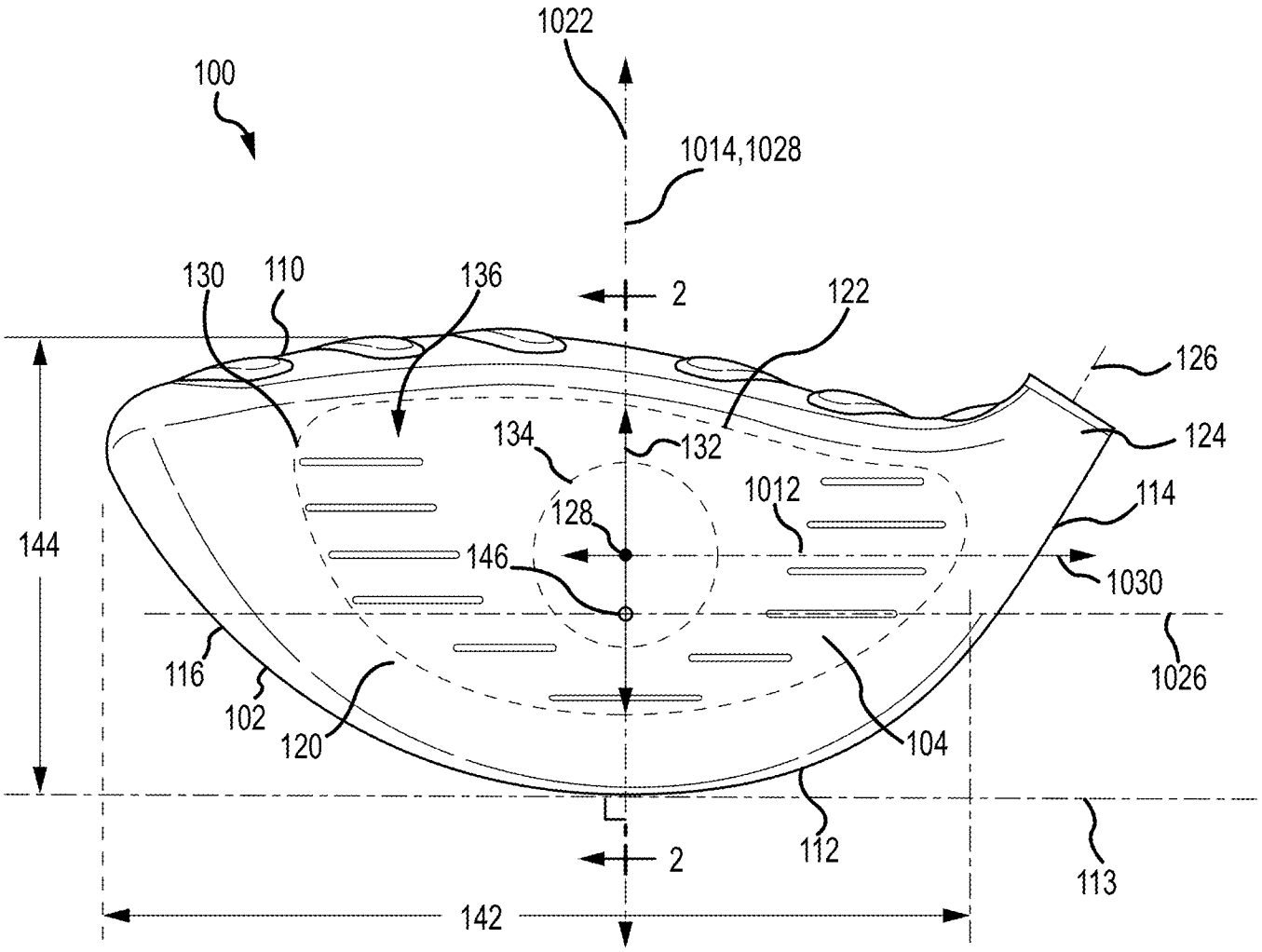
FIG. 3 is a front plan view of the golf club head of FIG. 1.

As shown in FIG. 3, the club head 100 further comprises a hosel structure 124 and a hosel axis 126 extending centrally along a bore of the hosel structure 124. The hosel structure 124 can be coupled to an end of a golf shaft (not shown). The golf shaft can be secured to the hosel structure 124 at a plurality of angles relative to the hosel axis 126. There can be other examples, however, where the shaft can be non-adjustably secured to the hosel structure 124.

Figure 4:
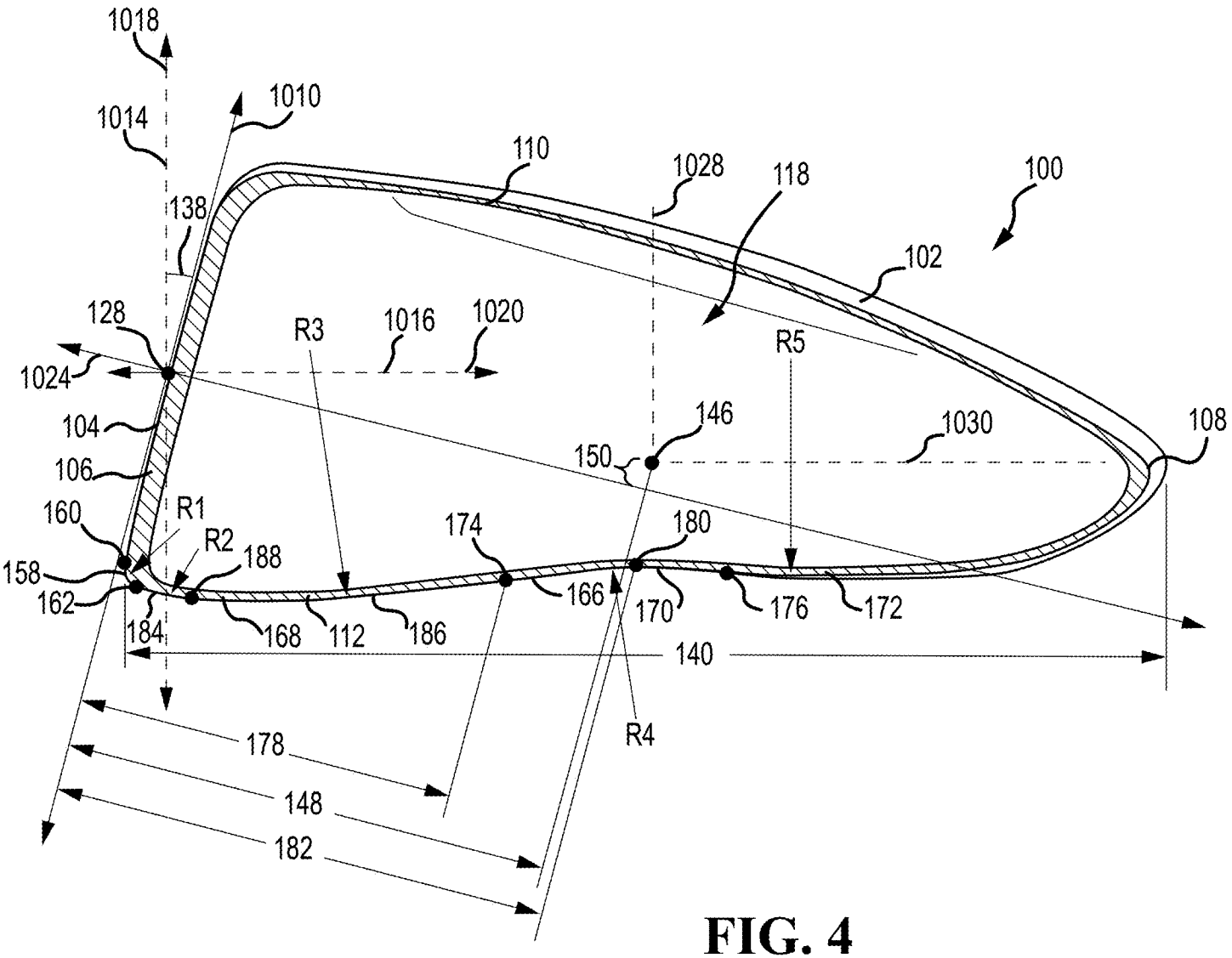
FIG. 4 is a cross-sectional view of the golf club head of FIG. 1, taken along a YZ plane as described herein.

The club head 100 defines a depth 140, a length 142, and a height 144. Referring to FIG. 4, the depth 140 of the club head 100 can be measured as the furthest extent of the club head 100 from the front end 106, to the back end 108, in a direction parallel to the Z axis 1016.

The length 142 of the club head 100 can be measured as the furthest extent of the club head 100 from the heel 114 to the toe 116, in a direction parallel to the X axis 1012, when viewed from the front view (FIG. 3). In many embodiments, the length 142 of the club head 100 can be measured according to a golf governing body such as the United States Golf Association (USGA). For example, the length 142 of the club head 100 can be determined in accordance with the USGA's Procedure for Measuring the Club Head Size of Wood Clubs (USGA-TPX3003, Rev. 2.1, Apr. 9, 2019).

The height 144 of the club head 100 can be measured as the furthest extent of the club head 100 from the crown 110 to the sole 112, in a direction parallel to the Y axis 1014, when viewed from the front view (FIG. 3). In many embodiments, the height 144 of the club head 100 can be measured according to a golf governing body such as the United States Golf Association (USGA). For example, the height 144 of the club head 100 can be determined in accordance with the USGA's Procedure for Measuring the Club Head Size of Wood Clubs.

In many embodiments, a volume (V) of the club head 100 is greater than approximately 150 cc, greater than approximately 160 cc, greater than approximately 170 cc, greater than approximately 170 cc, greater than approximately 180 cc, greater than approximately 190 cc, or greater than approximately 195 cc. In some embodiments, the volume (V) of the club head can be approximately 150 cc-198 cc, 160 cc-198 cc, 170 cc-198 cc, approximately 180 cc-198 cc, or approximately 190 cc-199 cc.

Further, in many embodiments, the volume of the club head 100 is greater than approximately 400 cc, greater than approximately 425 cc, greater than approximately 450 cc, greater than approximately 475 cc, greater than approximately 500 cc, greater than approximately 525 cc, greater than approximately 550 cc, greater than approximately 575 cc, greater than approximately 600 cc, greater than approximately 625 cc, greater than approximately 650 cc, greater than approximately 675 cc, or greater than approximately 700 cc. In some embodiments, the volume of the club head 100 can be approximately 400 cc-600 cc, 425 cc-500 cc, approximately 500 cc-600 cc, approximately 500 cc-650 cc, approximately 550 cc-700 cc, approximately 600 cc-650 cc, approximately 600 cc-700 cc, or approximately 600 cc-800 cc.

With continued reference to FIG. 3, the strikeface 104 of the club head 100 defines a centerpoint or geometric center 128. In some embodiments, the geometric center 128 can be located at the geometric centerpoint of a strikeface perimeter 130, and at a midpoint of a face height 132. In the same or other examples, the geometric center 128 also can be centered with respect to an engineered impact zone 134, which can be defined by a region of grooves 136 on the strikeface 104. As another approach, the geometric center 128 of the strikeface 104 can be in accordance with the definition of a golf governing body such as the United States Golf Association (USGA). For example, the geometric center 128 of the strikeface 104 can be determined in accordance with Section 2.1 of the USGA's Procedure for Measuring the Flexibility of a Golf Clubhead (USGA-TPX3004, Rev. 2.0, Apr. 9, 2019).

With reference to FIGS. 3 and 4, the club head 100 further defines a loft plane 1010 tangent to the geometric center 128 of the strikeface 104. The face height 132 can be measured parallel to loft plane 1010 between a top end of the strikeface perimeter 130 near the crown 110 and a bottom end of the strikeface perimeter 130 near the sole 112.

The geometric center 128 of the strikeface 104 further defines a coordinate system of golf club head 100 has an origin located at the geometric center 128 of the strikeface 104. The coordinate system further comprises an X axis 1012, a Y axis 1014, and a Z axis 1016. The X axis 1012 extends through the geometric center 128 of the strikeface 104 in a direction from the heel 114 to the toe 116 of the club head 100. The Y axis 1014 extends through the geometric center 128 of the strikeface 104 in a direction from the crown 110 to the sole 112 of the club head 100 and is perpendicular to the X axis 1012. The Z axis 1016 extends through the geometric center 128 of the strikeface 104 in a direction from the front end 106 to the back end 108 of the club head 100 and is perpendicular to the X axis 1012 as well as the Y axis 1014.

The coordinate system defines an XY plane 1018 extending through the X axis 1012 and the Y axis 1014; an XZ plane 1020 extending through the X axis 1012 and the Z axis 1016; and a YZ plane 1022 extending through the Y axis 1014 and the Z axis 1016. The XY plane 1018, the XZ plane 1020, and the YZ plane 1022 are all perpendicular to one another and intersect at the origin of the coordinate system located at the geometric center 128 of the strikeface 104. The XY plane 1018 extends parallel to the hosel axis 126 and is positioned at an angle corresponding to a loft angle 138 of the club head 100 from the loft plane 1010. Further, the X axis 1012 is positioned at an approximately 60 degree angle to the hosel axis 126 when viewed from a direction perpendicular to the XY plane 1018 (i.e., as viewed in FIG. 4). In other embodiments, the X axis 1012 can be positioned at a 45-70 degree angle to the hosel axis 126 when viewed from a direction perpendicular to the XY plane 1018.

In these or other embodiments, the club head 100 can be viewed from a front view (e.g., as in FIG. 3) when the strikeface 104 is viewed from a direction perpendicular to the XY plane 1018. Further, in these or other embodiments, the club head 100 can be viewed from a side view or side cross-sectional view (e.g., as in FIG. 4) when the heel 114 is viewed from a direction perpendicular to the YZ plane 1022.

As shown in FIGS. 3 and 4, the club head 100 further comprises a head center of gravity (CG) 146 and a head depth plane 1024 extending through the geometric center 128 of the strikeface 104, perpendicular to the loft plane 1010, in a direction from the heel 114 to the toe 116 of the club head 100. In many embodiments, the head CG 146 is located at a head CG depth from the XY plane 1018, measured in a direction perpendicular to the XY plane 1018. In some embodiments, the head CG 146 can be located at a head CG depth 148 from the loft plane 1010, measured in a direction perpendicular to the loft plane 1010. The head CG 146 is further located at a head CG height 150 from the head depth plane 1024, measured in a direction perpendicular to the head depth plane 1024. Further, the head CG height 150 is measured as the offset distance from the head depth plane 1024 in a direction perpendicular to the head depth plane 1024 toward the crown 110 or toward the sole 112. In many embodiments, the head CG height 150 is positive when the head CG 146 is located above the head depth plane 1024 (i.e., between the head depth plane 1024 and the crown 110), and the head CG height 150 is negative when the head CG 146 is located below the head depth plane 1024 (i.e., between the head depth plane 1024 and the sole 112). In some embodiments, the absolute value of the head CG height 150 can describe a head CG 146 positioned above or below the head depth plane 1024 (i.e., between the head depth plane 1024 and the crown 110 or between the head depth plane 1024 and the sole 112). In many embodiments, the head CG 146 is strategically positioned toward the sole 112 and back end 108 of the club head 100.

The head CG 146 defines an origin of a coordinate system having an X' axis 1026, a Y' axis 1028, and a Z' axis 1030. The Y' axis 1028 extends through the head CG 146 from the crown 110 to the sole 112, parallel to the hosel axis 126 when viewed from the side view, and at a 30 degree angle from the hosel axis 126 when viewed from the front view (i.e., as viewed in FIG. 3). The X' axis 1026 extends through the head CG 146 from the heel 114 to the toe 116 and perpendicular to the Y' axis 1028 when viewed from a front view and parallel to the XY plane 1018. The Z' axis 1030 extends through the head CG 146 from the front end 106 to the back end 108 and perpendicular to the X' axis 1026 and the Y' axis 1028. In many embodiments, the X' axis 1026 extends through the head CG 146 from the heel 114 to the toe 116, and parallel to the X axis 1012. The Y' axis 1028 extends through the head CG 146 from the crown 110 to the sole 112 parallel to the Y axis 1014. The Z' axis 1030 extends through the head CG 146 from the front end 106 to the back end 108 and parallel to the Z axis 1016.

While the above examples may be described in connection with a wood-type golf club 100, the apparatus, methods, and articles of manufacture described herein may be applicable to a variety of types of golf clubs including drivers, fairway woods, hybrids, crossovers, or any hollow body type golf clubs.

The club head 100 further comprises a loft angle (not shown) measured as the angle between the loft plane 1010 and the ground plane 113. In many embodiments, the loft angle ranges between approximately 7 degrees and 40 degrees. In some embodiments, the loft angle of the club head 100 is less than approximately 16 degrees, less than approximately 15 degrees, less than approximately 14 degrees, less than approximately 13 degrees, less than approximately 12 degrees, less than approximately 11 degrees, or less than approximately 10 degrees.

In many embodiments, the loft angle of the club head 100 is less than approximately 35 degrees, less than approximately 34 degrees, less than approximately 33 degrees, less than approximately 32 degrees, less than approximately 31 degrees, or less than approximately 30 degrees. Further, in many embodiments, the loft angle of the club head 100 is greater than approximately 12 degrees, greater than approximately 13 degrees, greater than approximately 14 degrees, greater than approximately 15 degrees, greater than approximately 16 degrees, greater than approximately 17 degrees, greater than approximately 18 degrees, greater than approximately 19 degrees, or greater than approximately 20 degrees. For example, in some embodiments, the loft angle of the club head 100 can be between 12 degrees and 35 degrees, between 15 degrees and 35 degrees, between 20 degrees and 35 degrees, or between 12 degrees and 30 degrees.

In many embodiments, the loft angle of the club head 100 is less than approximately 40 degrees, less than approximately 39 degrees, less than approximately 38 degrees, less than approximately 37 degrees, less than approximately 36 degrees, less than approximately 35 degrees, less than approximately 34 degrees, less than approximately 33 degrees, less than approximately 32 degrees, less than approximately 31 degrees, or less than approximately 30 degrees. Further, in many embodiments, the loft angle of the club head 100 is greater than approximately 16 degrees, greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, or greater than approximately 25 degrees.

The strikeface 104 of the club head 100 is formed from a first material. In many embodiments, the first material can be a metal alloy, such as a titanium alloy (e.g., Ti 7-4, Ti 6-4, T-9S, Ti SSAT2041, Ti SP700, Ti 15-0-3, Ti 15-5-3, Ti 3-8-6-4-4, Ti 10-2-3, Ti 15-3-3-3, Ti-6-6-2, Ti-185, HST-180, etc., or any combination thereof), a steel alloy (e.g., C300 steel, C350 steel, 455 steel, 431 steel, 475 steel, 565 steel, 17-4 stainless steel, maraging steel, Ni—Co—Cr steel alloy, etc.), an aluminum alloy, or any other metal or metal alloy. In other embodiments, the first material can be another material, such as a composite, plastic, thermoplastic composite, or any other suitable material or combination of materials.

The body 102 of the club head 100 is formed from a second material. In many embodiments, the second material can be a metal alloy, such as a titanium alloy (e.g., Ti 7-4, Ti 6-4, T-9S, Ti SSAT2041, Ti SP700, Ti 15-O-3, Ti 15-5-3, Ti 3-8-6-4-4, Ti 10-2-3, Ti 15-3-3-3, Ti-6-6-2, Ti-185, etc., or any combination thereof), a steel alloy (e.g., C300 steel, C350 steel, 455 steel, 431 steel, 475 steel, 565 steel, 17-4 stainless steel, maraging steel, Ni—Co—Cr steel alloy, etc.), an aluminum alloy, or any other metal or metal alloy. In other embodiments, the second[first] material can be another material, such as a composite, plastic, or any other suitable material or combination of materials. In the illustrated embodiment, the second material differs from the first material. In other embodiments, the first and second materials can be the same.

II. REVERSE CAMBER SOLE

Figure 2:
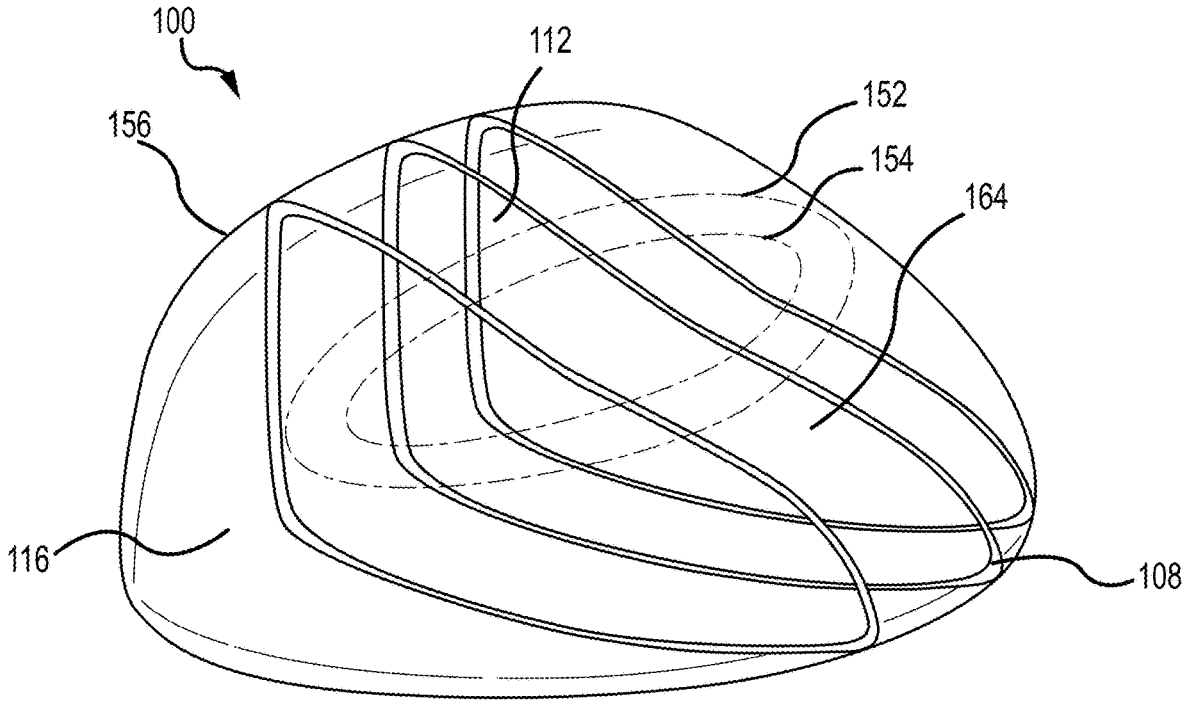
FIG. 2 is a back, crown-side perspective view of the golf club head of FIG. 1.

With reference to FIG. 2, the sole 112 of golf club head 100 further includes an indent or indented region 152 where the sole 112 veers inward in a direction toward the internal cavity 118 (FIG. 4). With respect to the XZ plane 1020 (FIG. 4), the indented region 152 includes a reverse camber region 154 that is convex relative to the XZ plane 1020. Typical prior art metalwoods include sole profiles that are only concave with respect to a comparable XZ plane. Accordingly, typical prior art metalwoods include sole profiles having relatively large radii of curvature between the front end and the back end (i.e., radii of curvature of around 22-25 inches). In contrast, the indented region 152 of the golf club head 100 allows the sole 112 to follow a much more tightly curved profile between the front end 106 and the back end 108. For example, in some embodiments of the club head 100, when viewed from a side cross-sectional view taken along the YZ plane 1022 (e.g., as viewed in FIG. 4), no portion of the sole 112 intersected by the YZ plane 1022 includes a radius of curvature greater than 10 inches between the front end 106 and the back end 108.

Moreover, in the illustrated embodiment of the club head 100, no portion of the sole 112 includes a radius of curvature greater than 6 inches when viewed from the side cross-sectional view taken along the YZ plane 1022. By implementing the indented region 152 into the sole 112, and thereby achieving relatively smaller radii of curvature of the sole 112 between the front and back ends 106 and 108, the club head body 102 experiences greater deformations in the sole 112 during impact with a golf ball. This results in an increase in the flexure of the golf club head 100 and more efficient energy transfer from the club head 100 to the ball during impact. The curvature of the sole 112 will be described in greater detail below.

With reference to FIG. 4, the club head 100 includes a face-sole transition boundary 156 (FIG. 2) where the front end 106 transitions to the sole 112. The face-sole transition boundary 156 extends between the front end 106 and the sole 112 from near the heel 114 to near the toe 116. A face-sole transition profile 158 is defined where the face-sole transition boundary 156 is intersected by the YZ plane 1022. That is, the face-sole transition profile 158 is the linear portion of the face-sole transition boundary 156 that is intersected by the YZ plane 1022, visible when viewed from a side cross sectional view taken along the YZ plane 1022 (e.g., as viewed in FIG. 4).

The face-sole transition profile 158 follows a face-sole transition radius of curvature R1. The face-sole transition profile 158 extends from a strikeface transition point 160, where a contour of the strikeface 104 departs from a roll radius of the strikeface 104, to a sole transition point 162, at which point the curvature of the sole 112 departs from the face-sole transition radius of curvature R1. The sole transition point 162 is defined by an intersection of the strikeface 104 and the sole 112. In some embodiments, the face-sole transition radius of curvature R1 comprises a constant radius of curvature extending from the strikeface transition point 160 to the sole transition point 162.

In some embodiments, the face-sole transition radius of curvature R1 can range from approximately 0.10 to 0.50 inches. For example, the face-sole transition radius of curvature R1 can be less than approximately 0.5 inches, less than approximately 0.475 inches, less than approximately 0.45 inches, less than approximately 0.425 inches, or less than approximately 0.40 inches. For further example, the face-sole transition radius of curvature R1 can be approximately 0.10 inches, 0.15 inches, 0.20 inches, 0.25 inches, 0.30 inches, 0.35 inches, 0.40 inches, 0.45 inches, or 0.50 inches.

With continued reference to FIG. 4, the sole 112 defines an exterior sole surface 164 (FIG. 2) extending from the front end 106 to the back end 108, and from the heel 114 to the toe 116. A sole curvature profile 166 of the club head 100 is defined as a linear extent of the sole surface 164 intersected by the YZ plane 1022 and extending from the sole transition point 162 to the back end 108. The sole curvature profile 166 includes a first concave section 168, a convex section 170, and a second concave section 172. The first concave section 168 extends from the sole transition point 162 to a first inflection point 174 and is concave relative to the XZ plane 1020 (convex relative to the ground plane 113). The first inflection point 174 is defined as a first point along the sole curvature profile 166 where, when following the sole curvature profile 166 from the front end 106 toward the back end 108, the sole curvature profile 166 reverses concavity with respect to the XZ plane 1020.

The convex section 170 of the sole curvature profile 166 extends from the first inflection point 174 to a second inflection point 176 and is convex relative to the XZ plane 1020 (concave relative to the ground plane 113). The second inflection point 176 is defined as a second point along the sole curvature profile 166 where, when following the sole curvature profile 166 from the front end 106 toward the back end 108, the sole curvature profile 166 reverses concavity with respect to the XZ plane 1020. The second concave section 172 of the sole curvature profile 166 extends from the second inflection point 176 to the back end 108 and is concave relative to the XZ plane 1020 (convex relative to the ground plane 113).

With continued reference to FIG. 4, the club head 100 further includes a first inflection point depth 178 measured along a direction perpendicular to the loft plane 1010 between the loft plane 1010 and the first inflection point 174. In many embodiments, the first inflection point depth 178 of the club head 100 is greater than 0.50 inches. In the illustrated embodiment, the first inflection point depth 178 is approximately 1.50 inches. In other embodiments, the first inflection point depth 178 of the club head 100 is greater than 0.75 inches, greater than 1.00 inches, greater than 1.10 inches, greater than 1.20 inches, greater than 1.30 inches, greater than 1.40 inches, greater than 1.50 inches, greater than 1.60 inches, greater than 1.70 inches, greater than 1.80 inches, greater than 1.90 inches, greater than 2.00 inches, greater than 2.25 inches, or greater than 2.50 inches. For example, in some embodiments, the first inflection point depth 178 of the club head 100 can be between 0.50-2.50 inches, between 1.00-2.00 inches, between 1.25-1.75 inches, between 1.35-1.65 inches, or between 1.45-1.55 inches. In some embodiments, the first inflection point depth 178 of the club head 100 can be 0.50 inches, 0.75 inches, 1.0 inches, 1.25 inches, 1.50 inches, 1.75 inches, 2.00 inches, 2.25 inches, or 2.50 inches.

A first inflection point depth ratio of the club head 100 is defined as a ratio of the first inflection point depth 178 to the depth 140 of the club head 100. In many embodiments, the first inflection point depth ratio is greater than 0.25. In other embodiments, the first inflection point depth ratio is greater than 0.30, greater than 0.31, greater than 0.32, greater than 0.33, greater than 0.34, greater than 0.35, greater than 0.36, greater than 0.37, greater than 0.38, greater than 0.39, greater than 0.40, or greater than 0.45. For example, in some embodiments, the first inflection point depth ratio of the club head 100 can be between 0.25-0.45, between 0.30-0.45, between 0.25-0.40, between 0.30-0.40, between 0.32-0.38, or between 0.34-0.36. In some embodiments, the first inflection point depth ratio of the club head 100 can be 0.25, 0.26, 0.27, 0.28, 0.29, 0.30, 0.31, 0.32, 0.33, 0.34, 0.35, 0.36, 0.37, 0.38, 0.39, 0.40, 0.41, 0.42, 0.43, 0.44, or 0.45.

With continued reference to FIG. 4, the sole 112 of the club head 100 further defines a nadir 180. The nadir 180 is located along a section of the sole curvature profile 166 that extends through the indented region 152 (FIG. 2). Specifically, the nadir 180 is defined as the point located on the sole curvature profile 166 within the indented region 152 and closest to the XZ plane 1020. In most embodiments, the nadir 180 is located on the convex section 170. In other words, the nadir 180 represents the lowest point of the indented region 152 as the indented region 152 extends toward the internal cavity 118.

The club head 100 further includes a nadir height (not shown) wherein the nadir height is measured perpendicularly from the ground plane 113 to the nadir 180. In many embodiments, the nadir height of the club head 100 ranges between 0.01 inches and 0.30 inches. In other embodiments, the nadir height of the club head 100 can range between 0.01-0.05 inches, 0.05-0.10 inches, 0.10-0.15 inches, 0.15-0.20 inches, 0.20-0.25 inches, or 0.25-0.30 inches. In other embodiments, the nadir height can be 0.01 inch, 0.02 inch, 0.03 inch, 0.04 inch, 0.05 inch, 0.06 inch, 0.07 inch, 0.08 inch, 0.09 inch, 0.10 inch, 0.11 inch, 0.12 inch, 0.13 inch, 0.14 inch, 0.15 inch, 0.16 inch, 0.17 inch, 0.18 inch, 0.19 inch, 0.20 inch, 0.21 inch, 0.22 inch, 0.23 inch, 0.24 inch, 0.25 inch, 0.26 inch, 0.27 inch, 0.28 inch, 0.29 inch, or 0.30 inch.

The club head 100 further includes a nadir depth 182 measured along a direction perpendicular to the loft plane 1010 between the loft plane 1010 and the nadir 180. In many embodiments, the nadir depth 182 of the club head 100 is greater than 1.5 inches. In other embodiments, the nadir depth 182 of the club head 100 is greater than 1.6 inches, greater than 1.7 inches, greater than 1.8 inches, greater than 1.9 inches, greater than 2.0 inches, greater than 2.1 inches, greater than 2.2 inches, greater than 2.3 inches, greater than 2.4 inches, or greater than 2.5 inches. For example, in some embodiments, the nadir depth 182 of the club head 100 can be between 1.5-3.0 inches, between 1.5-2.5 inches, between 2.0-3.0 inches, between 2.0-2.5 inches, or between 2.5-3.0 inches.

A nadir depth ratio of the club head 100 is defined as a ratio of the nadir depth 182 to the depth 140 of the club head 100. In many embodiments, the nadir depth ratio is greater than 0.35. In other embodiments, the nadir depth ratio is greater than 0.40, greater than 0.45, greater than 0.46, greater than 0.47, greater than 0.48, greater than 0.49, greater than 0.50, greater than 0.51, greater than 0.52, greater than 0.53, greater than 0.54, greater than 0.55, or greater than 0.60. For example, in some embodiments, the nadir depth ratio B of the club head 100 can be between 0.40-0.60, between 0.45-0.60, between 0.40-0.55, between 0.45-0.55, between 0.47-0.53, or between 0.49-0.51.

The sole curvature profile 166 of the club head 100 can also be described in terms of the radii of curvature along each of various sections of the sole curvature profile 166 between the front end 106 and the back end 108. With reference to FIG. 4, the first concave section 168 of the sole curvature profile 166 is divided into a first curvature section 184 having a first section radius of curvature R2, and a second curvature section 186 having a second section radius of curvature R3. The first curvature section 184 extends from the sole transition point 162 to a first concave section transition point 188, defined as a point along the sole curvature profile 166 where the first section radius of curvature R2 transitions to the second section radius of curvature R3. The second curvature section 186 extends from the first concave section transition point 188 to the first inflection point 174, which divides the second curvature section 186 from the convex section 170. The convex section 170 of the sole curvature profile 166 includes a convex section radius of curvature R4. Finally, the second concave section 172 includes a second concave section radius of curvature R5.

In some embodiments, the first section radius of curvature R2 can range from approximately 1.00 to 3.50 inches. In the illustrated embodiment, the first section radius of curvature R2 is approximately 1.75 inches. In other embodiments, the first section radius of curvature R2 can be less than 3.00 inches, less than 2.50 inches, less than 2.25 inches, less than 2.00 inches, or less than 1.75 inches. For example, the first section radius of curvature R2 may be approximately 1.00 inches, 1.25 inches, 1.5 inches, 1.75 inches, 2.00 inches, 2.25 inches, or 2.50 inches.

In some embodiments, the second section radius of curvature R3 can range from approximately 1.0 to 10.0 inches. In one embodiment, the second section radius of curvature R3 is approximately 6.0 inches. In other embodiments, the second section radius of curvature R3 can be less than 9.0 inches, less than 8.0 inches, less than 7.0 inches, less than 6.0 inches, less than 5.0 inches, less than 4.0 inches, less than 3.0 inches, or less than 2.0 inches. For example, the second section radius of curvature R3 may be approximately 3.0 inches, 4.0 inches, 5.0 inches, 6.0 inches, 7.0 inches, 8.0 inches, or 9.0 inches.

A nadir height ratio of the club head 100 is defined as the ratio of the nadir height to the radius of curvature R3 of the first concave section 168. The nadir height is inversely related to the radius of curvature R3. As the radius of curvature R3 decreases in magnitude, the nadir height increases. As the radius of curvature R3 increases in magnitude, the nadir height decreases. In many embodiments, the nadir height ratio is less than or equal to 0.33. In other embodiments, the nadir height ratio is less than 0.30, less than 0.25, less than 0.20, less than 0.15, less than 0.10, or less than 0.05. In other embodiments, the nadir height ratio can range between 0.001-0.05, 0.05-0.10, 0.10-0.15, 0.15-0.20, 0.20-0.25, 0.25-0.30, or 0.30-0.33.

In some embodiments, the convex section radius of curvature R4 can range from approximately 1.0 to 9.0 inches. In one embodiment, the convex section radius of curvature R4 is approximately 2.5 inches. In other embodiments, the convex section radius of curvature R4 can be less than 8.0 inches, less than 7.0 inches, less than 6.0 inches, less than 5.0 inches, less than 4.0 inches, less than 3.5 inches, less than 3.0 inches, or less than 2.5 inches. For example, the convex section radius of curvature R4 may be approximately 1.0 inches, 2.0 inches, 2.5 inches, 3.0 inches, 4.0 inches, 5.0 inches, 6.0 inches, 7.0 inches, 8.0 inches, or 9.0 inches.

In some embodiments, the second concave section radius of curvature R5 can range from approximately 3.0 to 10.0 inches. In the illustrated embodiment, the second concave section radius of curvature R5 is approximately 6.0 inches. In other embodiments, the second concave section radius of curvature R5 can be less than 9.0 inches, less than 8.0 inches, less than 7.0 inches, less than 6.0 inches, or less than 5.0 inches. For example, the second concave section radius of curvature R5 may be approximately 3.0 inches, 4.0 inches, 5.0 inches, 6.0 inches, 7.0 inches, 8.0 inches, or 9.0 inches. In other embodiments, the sole curvature profile 166 of the club head 100 can also be defined by a polynomial equation, or quadratic equation.

The indented region 152 as described above allows the sole 112 of the club head 100 to follow a much more tightly curved profile between the front end 106 and the back end 108 as compared to prior art metalwood club heads. (i.e. a radius of curvature greater than 10 inches as the sole curvature profile extends between the front end and the back end). This promotes greater deflection in the sole 112 of the club body 102 as the club head 100 impacts a golf ball. The relatively greater deflection of the club body 102 can yield a higher flexure of the club head 100 as compared to traditional metalwood golf clubs.

The golf club head 100 can increase the internal energy generated at impact between 1.0-8.0 lbf-inch over the control club. In some embodiments, the internal energy generated at impact by golf club head 200 can be 1.0 lbf-inch, 2.0 lbf-inch, 3.0 lbf-inch, 4.0 lbf-inch, 5.0 lbf-inch, 6.0 lbf-inch, 7.0 lbf-inch, or 8.0 lbf-inch. This substantial increase in internal energy can lead to the ball speed increasing by 0.1 mph, 0.2 mph, 0.3 mph, 0.4 mph, 0.5 mph, 0.6 mph, 0.7 mph, 0.8 mph, 0.9 mph, 1.0 mph, 1.1 mph, 1.2 mph, 1.3 mph, 1.4 mph, or 1.5 mph thereby increasing the travel distance of a golf ball between 1-10 yards. In some embodiments, the travel distance of a golf ball can increase 1 yard, 2 yards, 3 yards, 4 yards, 5 yards, 6 yards, 7 yards, 8 yards, 9 yards, or 10 yards.

Additionally, the relatively greater deflection of the sole 112 during impact can lead to a reduction in ball spin rate experienced by the golf ball upon impact with the club head 100. For example, the spin rate may be reduced by approximately 150 revolutions per minute (RPM). In some embodiments, the spin rate may be reduced by 10 RPM, 20 RPM, 30 RPM, 40 RPM, 50 RPM, 60 RPM, 70 RPM, 80 RPM, 90 RPM, 100 RPM, 110 RPM, 120 RPM, 130 RPM, 140 RPM, or 150 RPM. In some cases, the ball spin rate may be reduced by 160 RPM, 170 RPM, 180 RPM, 190 RPM, or even 200 RPM.

III. REVERSE CAMBER SOLE AND INTERNAL CURVED BEAMS

Figure 5:
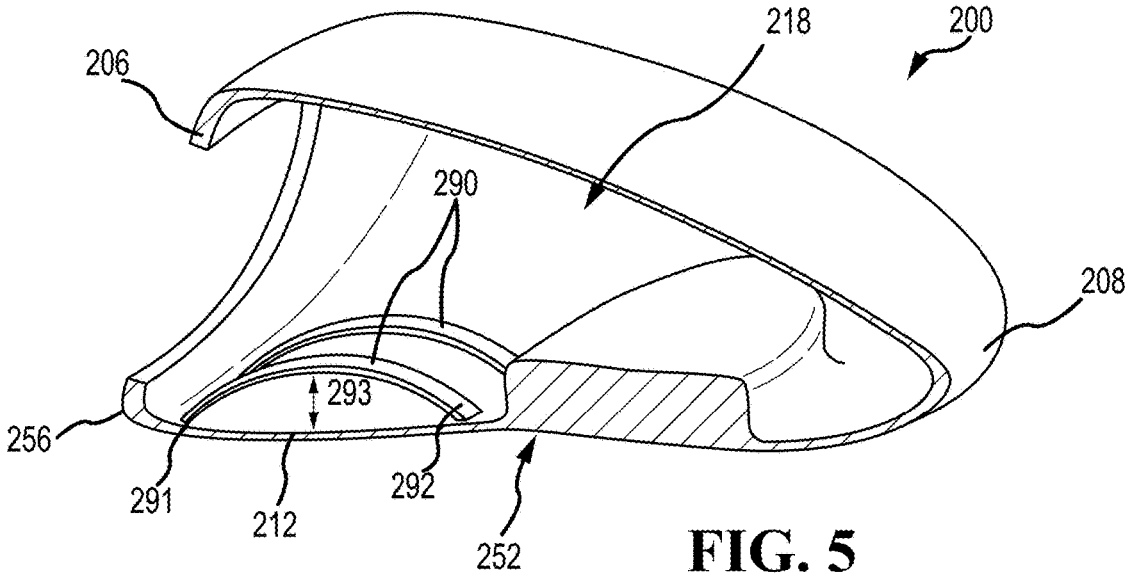
FIG. 5 is a perspective cross-sectional view of a golf club head, taken along the YZ plane.
Figure 6:
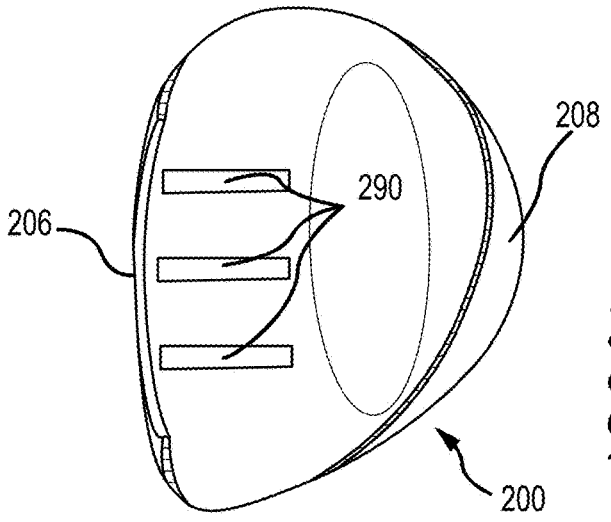
FIG. 6 is a top, cross-sectional view of the golf club head of FIG. 5.
Figure 7:
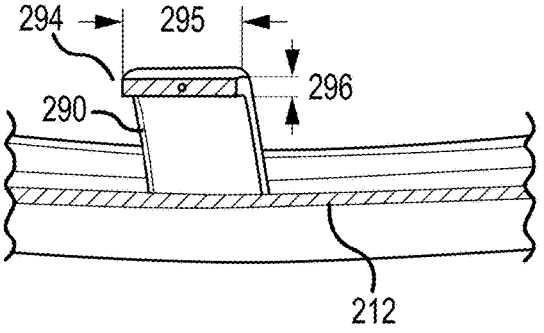
FIG. 7 is a detailed cross-sectional view of the golf club head of FIG. 5.

FIGS. 5-7 illustrate a golf club head 200 according to another embodiment of the invention. The golf club head 200 is similar to the golf club head 100 and includes substantially the same structure as the golf club head 100. Accordingly, the following description focuses primarily on the structure and features that are different from the embodiments described above in connection with FIGS. 1-4. Features and elements that are described in connection with FIGS. 1-4 are numbered in the 200 series of reference numbers in FIGS. 5-7. It should be understood that the features of the golf club head 200 that are not explicitly described below have the same properties as the features of the golf club head 100.

Like the golf club head 100, the golf club head 200 includes an indented region 252 (FIG. 5) formed in the sole 212. With reference to FIGS. 5 and 6, the golf club head 200 also includes internal beams 290 attached to the sole 212 at a first end 291 and at a second end 292, and extending through the internal cavity 218 of the golf club head 200 between the first and second ends 291, 292. In the illustrated embodiment, the golf club head 200 includes three beams 290. In other embodiments, the golf club head 200 may include one, two, four, five, six, seven, eight, nine, or ten beams 290.

The first end 291 of each beam 290 is attached to the sole 212 at a location proximate the front end 206 of the golf club head 200. For example, in the illustrated embodiment, the first end 291 is attached to a portion of the sole 212 adjacent the face-sole transition boundary 256. The second end 292 of each beam 290 is attached to the sole 212 at or proximate to the indented region 252.

Each beam 290 extends generally in a front-to-back direction, or in a direction generally along the Z axis 1016. In some embodiments, each beam 290 follows a generally straight-line path between the first and second ends 291, 292. In the illustrated embodiment, each beam 290 follows a curvilinear path between the first and second ends 291, 292. Specifically, each beam 290 follows a generally arc-shaped path between the first end 291 and the second end 292. Further, in the illustrated embodiment, the beams 290 extend generally parallel to one another, and each beam 290 follows generally the same arc-shaped path. In other embodiments, the beams 290 can follow different respective paths, relative to one another, between the first and second ends 291, 292.

A beam height 293 of each beam 290 is defined as a maximum distance between the beam 290 and an internal surface of the sole 212, measured perpendicular to the internal surface of the sole. The beam height 293 can range from 0.010 inch-1.000 inch. In some embodiments, the beam height 293 can range between 0.010-0.10 inch, 0.10-0.20 inch, 0.20-0.30 inch, 0.30-0.40 inch, 0.40-0.50 inch, 0.50-0.60 inch, 0.60-0.70 inch, 0.70-0.80 inch, 0.80-0.90 inch, or 0.90-1.0 inch. In some embodiments, the beam height 293 can be 0.10 inch, 0.20 inch, 0.30 inch, 0.40 inch, 0.50 inch, 0.60 inch, 0.70 inch, 0.80 inch, 0.90 inch, or 1.0 inch.

With reference to FIG. 7, each beam 290 includes a cross-sectional shape 294, defined where the beam 290 is intersected by a plane extending perpendicular to the path of the beam 290. In the illustrated embodiment, the cross-sectional shape 294 of each beam 290 is rectangular. In other embodiments, the cross-sectional shape 294 of each beam 290 may be circular, triangular, rectangular, trapezoidal, octagonal, or any other desirable cross-sectional shape.

In the illustrated embodiment, the cross-sectional shape 294 of each beam 290 includes a width 295, measured generally in a heel-toe direction, and a thickness 296, measured generally in a crown-sole direction. The width 295 can range from approximately 0.010 inch-1.000 inch. The width 295 can be 0.010 inch, 0.05 inch, 0.10 inch, 0.20 inch, 0.30 inch, 0.40 inch, 0.50 inch, 0.60 inch, 0.70 inch, 0.80 inch, 0.90 inch, or 1.0 inch. In the illustrated embodiment, the width 295 is approximately 0.2 inch.

The thickness 296 can range from approximately 0.010 inch-0.500 inch. In some embodiments, the thickness 296 can be 0.010 inch, 0.015 inch, 0.020 inch, 0.025 inch, 0.030 inch, 0.035 inch, 0.040 inch, 0.045 inch, or 0.050 inch. In the illustrated embodiment, the thickness 296 is approximately 0.033 inch. Moreover, each beam 290 is spaced from each adjacent beam by approximately 0.5 inch.

In other embodiments, the beams 290 may be spaced apart from one another by a distance ranging from 0.050 inch-1.000 inch. In some embodiments, the beams 290 can be spaced apart from one another by a distance of 0.010 inch, 0.015 inch, 0.020 inch, 0.025 inch, 0.030 inch, 0.035 inch, 0.040 inch, 0.045 inch, or 0.050 inch In some embodiments, the beams 290 can be formed from the same material as the body 204 of the club head 200 and can be integrally formed with the body 204. In other embodiments, the beams 290 can be formed separately from the body 204 and coupled to the body 204 with joining methods such as welding, epoxying, or any other suitable joining method. In these embodiments, the beams 290 can be formed from the same or a different material from the body 204 of the club head 200.

Figure 8:
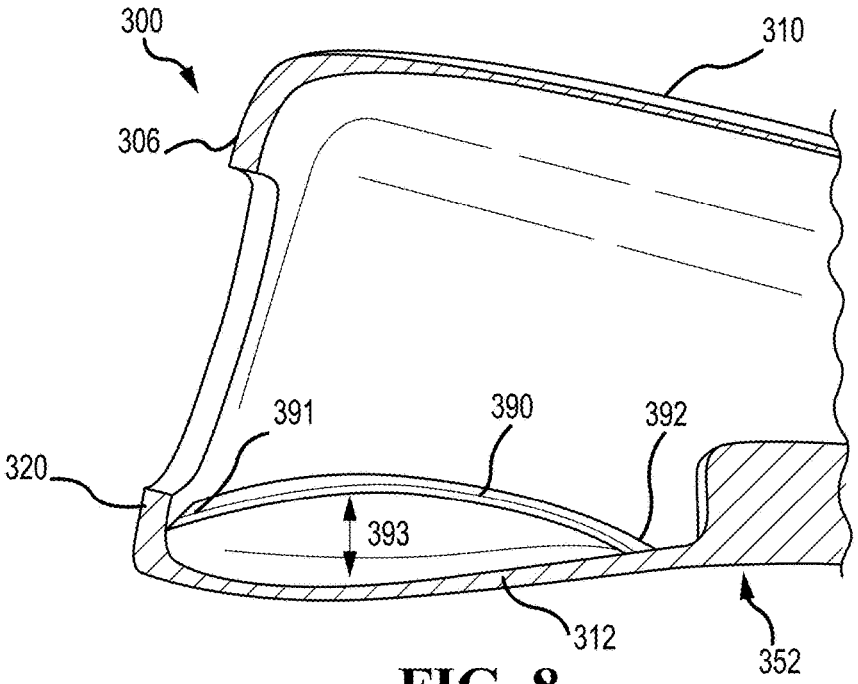
FIG. 8 is cross-sectional view of a portion of a golf club head, taken along the YZ plane.
Figure 9:
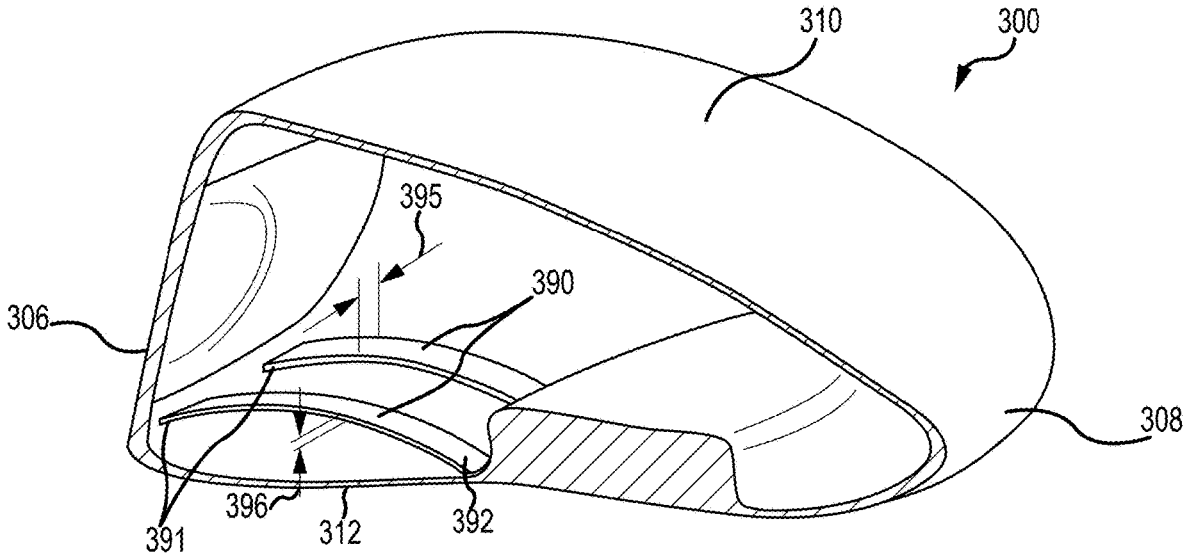
FIG. 9 is a perspective cross-sectional view of the golf club head of FIG. 8, taken along the YZ plane.

FIGS. 8 and 9 illustrate a golf club head 300 according to another embodiment of the invention. The golf club head 300 is similar to the golf club head 200 and includes substantially the same structure as the golf club head 200. Accordingly, the following description focuses primarily on the structure and features that are different from the embodiments described above in connection with FIGS. 5-7. Features and elements that are described in connection with FIGS. 5-7 are numbered in the 300 series of reference numbers in FIGS. 8 and 9. It should be understood that the features of the golf club head 300 that are not explicitly described below have the same properties as the features of the golf club head 200.

Like the golf club head 100 and 200, the golf club head 300 includes an indented region 352 formed in the sole 312. And, like the golf club head 200, the golf club head 300 includes internal beams 390 extending between a first end 391 and a second end 392. However, unlike the golf club head 200, the first ends 391 of the beams 390 of the club head 300 are not attached to the sole 312. Rather, the first end 391 of each beam 390 is attached to the front end 306. Specifically, the first end 391 of each beam 390 is attached to the perimeter portion 320 of the front end 306. Moreover, in the illustrated embodiment, the club head 300 includes four beams 390. In other embodiments, the club head 300 may include one, two, three, five, six, seven, eight, nine, or ten beams 290. The beams 390 of the club head 300 can follow any of the paths described above with respect to the club head 200. Likewise, the beams 390 can include a beam height 393, a cross-sectional shape 394, a width 395, and a thickness 396 similar to the beam height 293, the cross-sectional shape 294, the width 295, and the thickness 296 described above with respect to the club head 200.

IV. EXAMPLES

Example 1: Golf Club Head with Reverse Camber Sole

Figure 10:
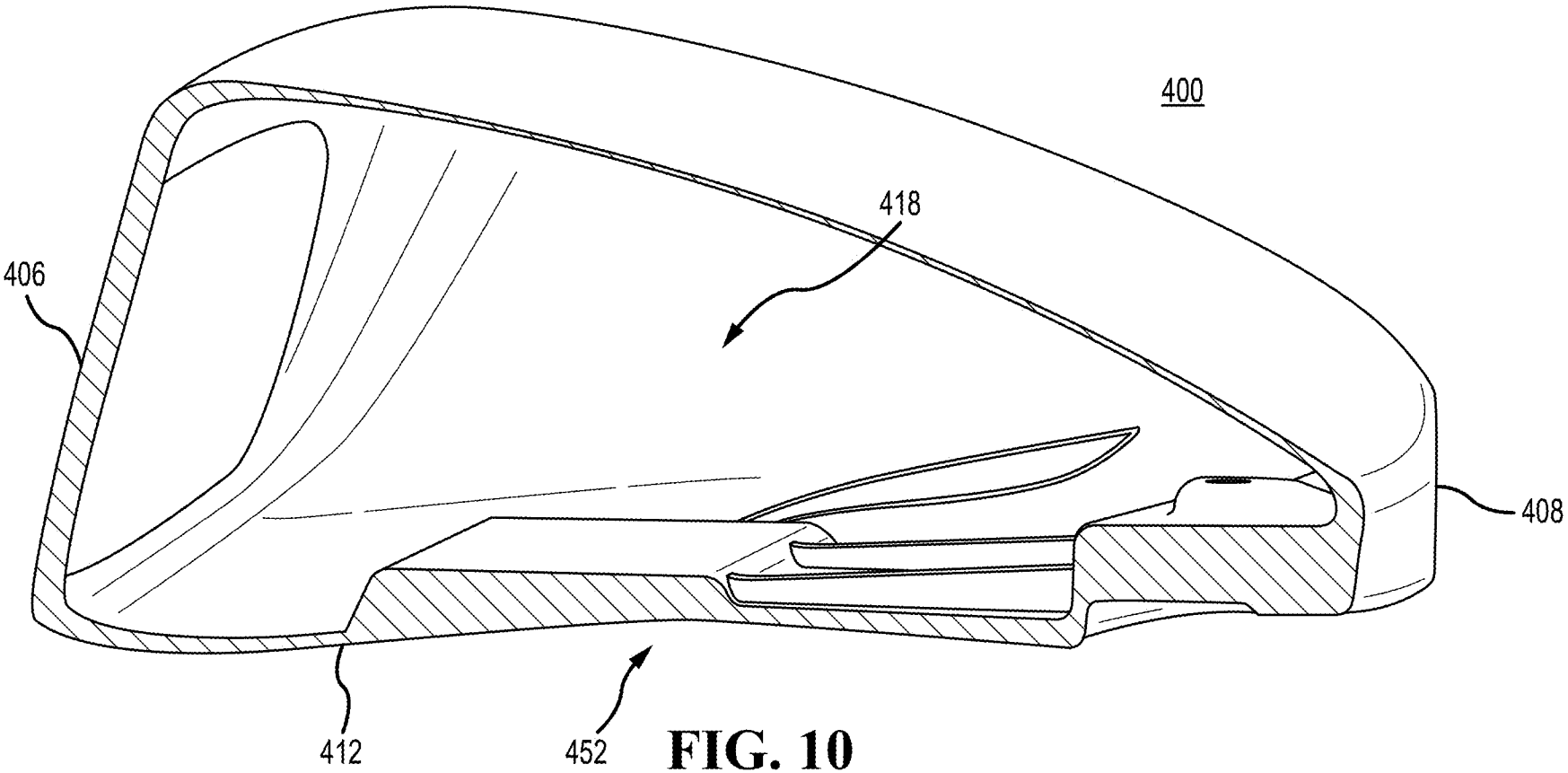
FIG. 10 is a perspective cross-sectional view of a golf club head.
Figure 12:
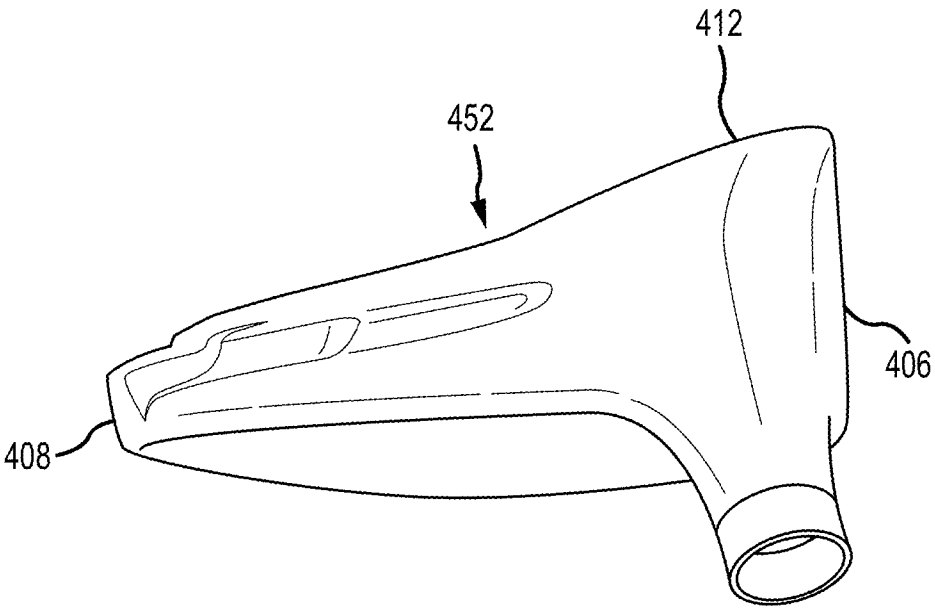
FIG. 12 is a heel-side perspective view of the golf club head of FIG. 10.
Figure 11:
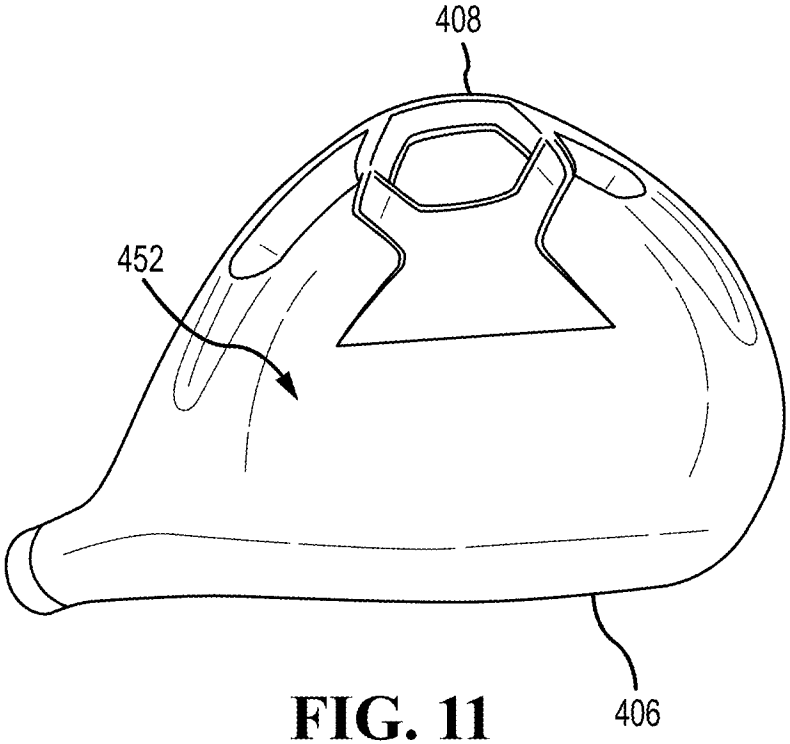
FIG. 11 is a bottom view of the golf club head of FIG. 10.

Referring to FIGS. 10-12, is a wood-type golf club head 400 having a sole 412 with an indent or indented region 452 where the sole 412 veers inward in a direction toward the internal cavity 418 of the club head 400. Accordingly, typical woods include sole profiles having relatively large radii of curvature between the front end and the back end (i.e., radii of curvature of around 22-25 inches). In contrast, the indented region 452 of the golf club head 400 allows the sole 412 to follow a much more tightly curved profile between the front end 406 and the back end 408. Moreover, in the illustrated embodiment of the club head 400, no portion of the sole 412 includes a radius of curvature greater than 6 inches when viewed from the side cross-sectional view taken along the YZ plane 4022.

The indented region 452 as described above allows the sole 412 of the club head 400 to follow a much more tightly curved profile between the front end 406 and the back end 408 as compared to metalwood club heads without this profile. This promotes greater deflection in the sole 412 of the club body 402 as the club head 400 impacts a golf ball. The greater deflection of the club body 402 generates a greater amount of internal energy within club head 400 as compared to traditional metalwood golf clubs without the indented region 452.

Figure 13:
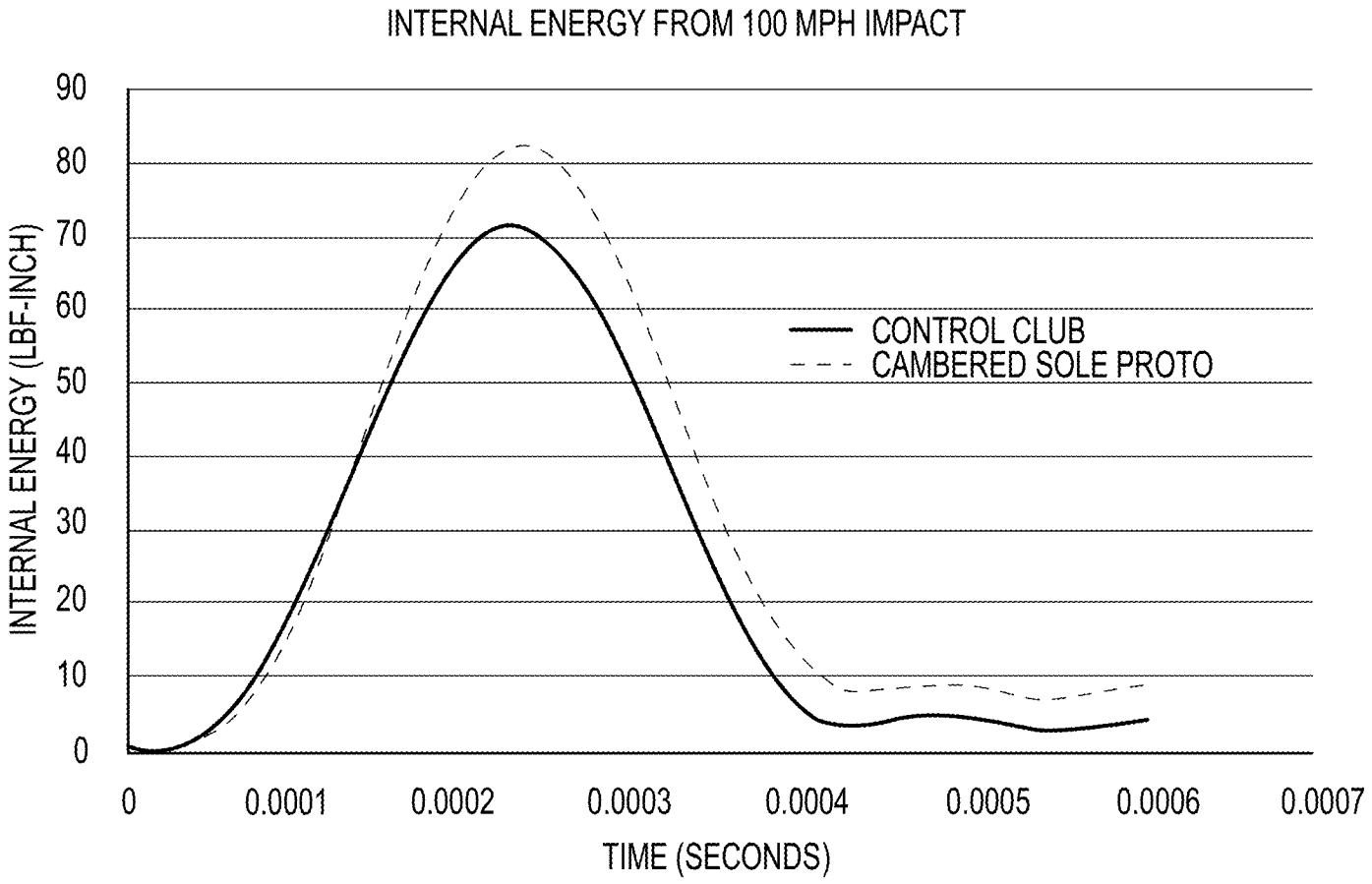
FIG. 13 is a graphical representation of the internal energy generated by the golf club of FIG. 10

Referring to FIG. 13, the internal energy generated at impact by golf club head 400 was compared to the internal energy generated at impact by a golf club head (hereafter "control club") devoid of the indented region in the sole (a sole profile having relatively large radii of curvature between the front and back end of the club). The indented region 452 of golf club head 400, generates an increase in the internal energy of golf club head 400 by approximately 7.8 lbf-inch over the control club and thereby increases deflection. This 7.8 lbf-inch increase in internal energy translates to an approximately 1.0 mile per hour (mph)

increase in ball speed (at a swing speed of 100 mph), thereby increasing a golf shot by at least 5 yards. Furthermore, the indented sole 412 of golf club head 400, retains more vibrational energy, immediately following impact, in the golf club head, allowing for higher energy transfer from the golf club head 400 to a golf ball, thereby increasing ball speed.

Further, the indented region 452 of golf club head 400, improves the ball speed of shots hit below the center of the strike face. The increased deflection of the indented sole 412 mitigates the high backspin caused by low face hits, leading to farther traveling golf shots than the control club. The indented region 452 in the sole 412 allows the front end 406 of the club head 400 to compress in a spring-like fashion down towards a ground plane and towards the back end 408 of the golf club head 400. This creates spring energy and delofts the golf club 400, thereby increasing the overall internal energy of the golf club 400 and decreasing the spin rate.

Additionally, the relatively greater deflection of the sole 412 during impact can lead to a reduction in ball spin rate experienced by the golf ball upon impact with the club head 400, over the control club. In one embodiment, the spin rate may be reduced by up to 150 revolutions per minute (RPM). In some embodiments, the ball spin rate may be reduced from around 600 RPM to around 450 RPM. The combination of increased ball speed and decreased spin rate, generated by the increased deflection of golf club head 400, leads to straighter and farther traveling golf shots, over the control club.

Example 2: Golf Club Head with Reverse Camber Sole and Internal Curved Beams

In one embodiment, an example golf club head 200 with reverse camber sole 212 (indented region 252) and one or more internal curved beams 290 was compared to a golf club head (hereafter "control club") with an extremely flexible reverse camber sole devoid of any internal curved beams. The one or more internal curved beams 290 function to partially stiffen and support flexible cambered sole 212.

As aforementioned the reverse camber sole 212 can increase the internal energy and resultant ball speed of a golf ball struck by the golf club head 200. However, for extremely fast golf swings, the reverse camber sole 212, may need reinforcement (one or more internal curved beams 292) to prevent permanent deformation of the sole 212 or fracture of the sole 212.

In comparison to the control club, the example golf club head 200, prevents some flexure in the sole 212, caused by the indented region 252. However, the golf club head 200, although not as flexible as the control club, still allows substantial flexure of the overall club head 200 and strikeface 204, thereby increasing the internal energy of the golf club head 200, while structurally reinforcing the sole 212.

In some embodiments, the example golf club head 200 with reverse camber sole 212 and one or more internal curved beams 290, can increase the internal energy generated at impact between 1.0-7.0 lbf-inch over the control club. In some embodiments, the internal energy generated at impact by golf club head 200 can be 1.0 lbf-inch, 2.0 lbf-inch, 3.0 lbf-inch, 4.0 lbf-inch, 5.0 lbf-inch, 6.0 lbf-inch, or 7.0 lbf-inch. This substantial increase in internal energy can lead to the ball speed increasing by 0.1 mph, 0.2 mph, 0.3 mph, 0.4 mph, 0.5 mph, 0.6 mph, 0.7 mph, 0.8 mph, 0.9 mph, or 1.0 mph, thereby increasing the travel distance of a golf ball by up to 5 yards.

Various features and advantages of the disclosures are set forth in the following claims.

Clause 1: A hollow body golf club comprising: a body having a front end; a back end opposite the front end; a crown; a sole opposite the crown, the sole defining a sole surface; wherein a ground plane is tangent to the sole surface when the golf club head is at an address position to strike a golf ball; a heel; a toe opposite the heel, and a hosel structure having a hosel axis extending centrally through a bore in the hosel structure; a strikeface positioned at the front end and defining a geometric center, and a loft plane tangent to the geometric center; wherein the geometric center further defines a coordinate system having the geometric center; the coordinate system comprising an X axis extending through the geometric center between the heel and the toe; a Y axis extending through the geometric center and perpendicular to the X axis, between the crown and the sole; a Z axis extending through the geometric center and perpendicular to the X axis and to the Y axis, between the front end and the back end; the Y axis and the Z axis together define a YZ plane extending between the crown and the sole and between the front end and the back end; a sole transition point defined by an intersection of the sole and the strike face; a sole curvature profile defined by an intersection of the sole surface and the YZ plane; the sole curvature profile comprises a radius of curvature that varies as the sole curvature profile extends between the front end and the back end; and wherein the radius of curvature is equal to or less than 10 inches as the sole curvature profile extends between the front end and the back end.

Clause 2: a hollow body golf club head comprising: a body having a front end, a back end opposite the front end, a crown, a sole opposite the crown, the sole defining a sole surface, a heel, a toe opposite the heel, and a hosel structure having a hosel axis extending centrally through a bore in the hosel structure; a strikeface positioned at the front end and defining a geometric center, and a loft plane tangent to the geometric center; wherein: the geometric center further defines a coordinate system having an origin located at the geometric center, the coordinate system including an X axis extending through the geometric center between the heel and the toe, a Y axis extending through the geometric center and perpendicular to the X axis, between the crown and the sole, and a Z axis extending through the geometric center and perpendicular to the X axis and to the Y axis, between the front end and the back end; the X axis and the Z axis together define an XZ plane extending between the heel end and the toe end and between the front end and the back end; the Y axis and the Z axis together define a YZ plane extending between the crown and the sole and between the front end and the back end; a sole curvature profile is defined by an intersection of the sole surface and the YZ plane; the sole curvature profile includes a first concave section, a convex section, and a second concave section, the first concave section being located adjacent the front end and being concave relative to the XZ plane, the second concave section being located adjacent the back end and being concave relative to the XZ plane, and the convex section being located between the first concave section and the second concave section and being convex relative to the XZ plane; the sole curvature profile further includes an inflection point that divides the first concave section and the convex section; the club head defines an inflection point depth measured between the loft plane and the inflection point along a direction perpendicular to the loft plane; the club head defines a club head depth measured between a furthest extent of the front end and a furthest extent of the back end in a direction parallel to the Z axis; an inflection point depth ratio is defined as a ratio of the inflection point depth to the club head depth; and the inflection point depth ratio is between 0.25 and 0.45.

Clause 3: A hollow body golf club head comprising: a body having a front end, a back end opposite the front end, a crown, a sole opposite the crown, a heel, a toe opposite the heel, and a hosel structure having a hosel axis extending centrally through a bore in the hosel structure; a strikeface positioned at the front end and defining a geometric center, and a loft plane tangent to the geometric center; wherein: the geometric center further defines a coordinate system having an origin located at the geometric center, the coordinate system including an X axis extending through the geometric center between the heel and the toe, a Y axis extending through the geometric center and perpendicular to the X axis, between the crown and the sole, and a Z axis extending through the geometric center and perpendicular to the X axis and to the Y axis, between the front end and the back end; the X axis and the Z axis together define an XZ plane extending between the heel end and the toe end and between the front end and the back end; the sole includes an indented region where the sole extends toward the XZ plane; the indented region defines a nadir where the indented region extends closest to the XZ plane along a direction perpendicular to the XZ plane; the club head defines a nadir depth measured between the loft plane and the nadir along a direction perpendicular to the loft plane; the club head defines a club head depth measured between a furthest extent of the front end and a furthest extent of the back end in a direction parallel to the Z axis; a nadir depth ratio is defined as a ratio of the nadir depth to the club head depth; and the nadir depth ratio is between 0.45 and 0.60.

Clause 4: The golf club head of clause 1, wherein the radius of curvature comprises a first inflection point and a second inflection point; wherein the sole curvature comprises a first concave section extending from the sole transition point to the first inflection point and is concave relative to the XZ plane; a convex section extending from the first inflection point to the second inflection point and is convex relative to the XZ plane; and a second concave section extending from the second inflection point to the back end and is concave relative to the XZ plane.

Clause 5: The golf club head of clause 4, wherein the first concave section comprises a radius of curvature (R3); the convex section comprises a radius of curvature (R4); and the second concave section comprises a radius of curvature (R5).

Clause 6: The golf club head of clause 5, wherein the sole curvature profile comprises a nadir; wherein the nadir represents the point on the sole curvature profile that is closest to the XZ plane; and wherein the nadir is located on the convex portion.

Clause 7: The golf club head of clause 6, wherein the nadir comprises a nadir height; wherein the nadir height is measured perpendicularly from the ground plane to the nadir.

Clause 8: The golf club head of clause 7, wherein the nadir height is inversely related to radius of curvature (R3) of the first concave section.

Clause 9: The golf club head of clause 8, further comprises a nadir height ratio; wherein the nadir height ratio is defined as the ratio of the nadir height to the radius of curvature (R3) of the first concave section.

Clause 10: The golf club head of clause 9, wherein the nadir height ratio is less than 0.33.

Clause 11: The golf club head of clause 10, wherein the nadir height ratio is between 0.001 and 0.05.

Clause 12: The golf club head of clause 5, wherein the radii of curvature R3 and R5 are equivalent and greater than R4.

Clause 13: The golf club head of clause 5, wherein the radius of curvature R3 is at least twice as great as radius of curvature R4.

Clause 14: The golf club head of clause 8, further comprises an depth and a nadir depth; wherein the depth of the club head is measured as the furthest point from the front end to the back end, in a direction parallel to the Z axis; and wherein the nadir depth is measured perpendicularly from the loft plane to the nadir.

Clause 15: The golf club head of clause 14, further comprises a nadir depth ratio; wherein the nadir depth ratio is defined as the ratio of the nadir depth to the depth of the club head.

Clause 16: The golf club head of clause 15, wherein the nadir depth ratio is greater than 0.35.

Clause 17: The golf club head of clause 16, wherein the nadir depth ratio is between 0.40 and 0.60.

Clause 18: The golf club head of clause 5, wherein the radius of curvature R5 is greater than 10 inches.

Clause 19: The golf club head of clause 15, wherein the first inflection point comprises a depth; wherein the first inflection point depth is measured between the loft plane and the first inflection point along a direction perpendicular to the loft plane.

Clause 20: The golf club head of clause 19, further comprises an inflection point depth ratio; wherein the inflection point depth ratio is defined as the ratio of the first inflection point depth to the depth of the club head.

Clause 21: The golf club head of clause 20, wherein the inflection point depth ratio is greater than 0.25.

Clause 22: The golf club head of clause 21, wherein the inflection point depth ratio is between 0.25 and 0.45.

Replacement of one or more claimed elements constitutes reconstruction and not repair. Additionally, benefits, other advantages, and solutions to problems have been described regarding specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a wood-type golf club, the apparatus, methods, and articles of manufacture described herein may be applicable to a variety of types of golf clubs including drivers, fairway woods, hybrids, crossovers, or any hollow body type golf clubs.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Although the invention has been described in detail with reference to certain preferred embodiments, variations and modifications exist within the scope and spirit of one or more independent aspects of the invention as described.

The invention claimed is:

1. A hollow body golf club head comprising:

a body having a front end;

a back end opposite the front end;

a crown;

a sole opposite the crown, the sole defining a sole surface;

wherein a ground plane is tangent to the sole surface when the golf club head is at an address position to strike a golf ball;

a heel;

a toe opposite the heel, and a hosel structure having a hosel axis extending centrally through a bore in the hosel structure;

an interval cavity;

a strikeface positioned at the front end and defining a geometric center, and a loft plane tangent to the geometric center;

wherein the geometric center further defines a coordinate system having the geometric center;

the coordinate system comprising an X axis extending through the geometric center between the heel and the toe;

a Y axis extending through the geometric center and perpendicular to the X axis, between the crown and the sole;

a Z axis extending through the geometric center and perpendicular to the X axis and to the Y axis, between the front end and the back end;

the X axis and the Z axis together define an XZ plane extending between the heel and toe and between the front end and the back end;

the Y axis and the Z axis together define a YZ plane extending between the crown and the sole and between the front end and the back end;

an indented region;

wherein the indented region is defined where the sole veers inward in a direction toward the internal cavity;

a sole transition point defined by an intersection of the sole and the strikeface;

the indented region comprises a sole curvature profile defined by an intersection of the sole surface and the YZ plane;

wherein the sole curvature profile comprises a first inflection point and a second inflection point;

wherein the sole curvature profile comprises a first concave section extending from the sole transition point to the first inflection point and is concave relative to the XZ plane;

a convex section extending from the first inflection point to the second inflection point and is convex relative to the XZ plane;

a second concave section extending from the second inflection point to the back end and is concave relative to the XZ plane;

wherein:

the first concave section comprises a radius of curvature (R3);

the convex section comprises a radius of curvature (R4);

the second concave section comprises a radius of curvature (R5);

the sole curvature profile further comprises a nadir and a nadir depth ratio;

the nadir represents a point on the sole curvature profile that is closest to the XZ plane;

the nadir is located on the convex section;

wherein the nadir depth ratio is defined as a ratio of a depth of the nadir to a depth of the golf club head; and wherein the nadir depth ratio is between 0.40 and 0.50;

a face-sole transition profile located where the strikeface transitions to the sole, the face-sole transition profile comprising a face-sole transition radius of curvature;

wherein the face-sole transition radius of curvature is less than 0.5 inches; and wherein no portion of the sole intersected by the YZ plane includes a radius of curvature greater than 10 inches between the front end and the back end.

2. The golf club head of claim 1, wherein the depth of the nadir is greater than 1.5 inches.

3. The golf club head of claim 1, wherein the depth of the nadir is greater than 2 inches.

4. The golf club head of claim 1, wherein the depth of the nadir is greater than 2.5 inches.

5. The golf club head of claim 1, wherein the nadir depth ratio is between 0.45 and 0.50.

6. The golf club head of claim 1, wherein the depth of the nadir is between 2.5 and 3.0 inches.

7. The golf club head of claim 1, wherein a volume of the club head is greater than approximately 400 cc.

8. The golf club head of claim 1, wherein the radii of curvature R3 and R5 are equivalent or greater than R4.

9. The golf club head of claim 1, wherein the radius of curvature R3 is at least twice of the radius of curvature R4.

10. A hollow body golf club comprising:

a body having a front end;

a back end opposite the front end;

a crown;

a sole opposite the crown, the sole defining a sole surface;

wherein a ground plane is tangent to the sole surface when the golf club head is at an address position to strike a golf ball;

a heel;

a toe opposite the heel, and a hosel structure having a hosel axis extending centrally through a bore in the hosel structure;

an interval cavity;

a strikeface positioned at the front end and defining a geometric center, and a loft plane tangent to the geometric center;

wherein the geometric center further defines a coordinate system having the geometric center;

the coordinate system comprising an X axis extending through the geometric center between the heel and the toe;

a Y axis extending through the geometric center and perpendicular to the X axis, between the crown and the sole;

a Z axis extending through the geometric center and perpendicular to the X axis and to the Y axis, between the front end and the back end;

the X axis and the Z axis together define an XZ plane extending between the heel and toe and between the front end and the back end;

the Y axis and the Z axis together define a YZ plane extending between the crown and the sole and between the front end and the back end;

an indented region;

wherein the indented region is defined where the sole veers inward in a direction toward the internal cavity;

a sole transition point defined by an intersection of the sole and the strikeface;

the indented region comprises a sole curvature profile defined by an intersection of the sole surface and the YZ plane;

wherein the sole curvature profile comprises a first inflection point and a second inflection point;

wherein the sole curvature profile comprises a first concave section extending from the sole transition point to the first inflection point and is concave relative to the XZ plane;

a convex section extending from the first inflection point to the second inflection point and is convex relative to the XZ plane;

a second concave section extending from the second inflection point to the back end and is concave relative to the XZ plane;

wherein:

the first concave section comprises a radius of curvature (R3);

the convex section comprises a radius of curvature (R4);

the second concave section comprises a radius of curvature (R5);

the sole curvature profile further comprises a nadir, a nadir depth ratio, and a nadir height ratio;

the nadir represents a point on the sole curvature profile that is closest to the XZ plane;

the nadir is located on the convex section;

the nadir height ratio is defined as the ratio of a nadir height to the radius of curvature (R3) of the first concave section; and wherein the nadir height ratio is less than 0.33; and the nadir depth ratio is defined as a ratio of a depth of the nadir to a depth of the golf club head;

and wherein the nadir depth ratio is between 0.40 and 0.60.

11. The golf club head of claim 10, wherein the depth of the nadir is greater than 1.5 inches.

12. The golf club head of claim 10, wherein the depth of the nadir is greater than 2 inches.

13. The golf club head of claim 10, wherein the depth of the nadir is greater than 2.5 inches.

14. The golf club head of claim 10, wherein the nadir depth ratio is between 0.45 and 0.60.

15. The golf club head of claim 10, wherein the depth of the nadir is between 2.5 and 3.0 inches.

16. The golf club head of claim 10, wherein the nadir height ratio is less than 0.30.

17. The golf club head of claim 10, wherein the radii of curvature R3 and R5 are equivalent or greater than R4.

18. The golf club head of claim 10, wherein the radius of curvature R3 is at least twice of the radius of curvature R4.

19. The golf club head of claim 10, wherein the radius of curvature R5 is greater than 10 inches.

* * * * *